US008032362B2

(12) United States Patent
Choo et al.

(10) Patent No.: US 8,032,362 B2
(45) Date of Patent: Oct. 4, 2011

(54) AUDIO SIGNAL ENCODING/DECODING METHOD AND APPARATUS

(75) Inventors: Ki-hyun Choo, Seoul (KR); Eun-mi Oh, Seongnam-si (KR); Jung-hoe Kim, Seoul (KR); Konstantin Osipov, Saint Petersburg (RU); Sergey Petrov, Saint Petersburg (RU)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1007 days.

(21) Appl. No.: 11/867,218

(22) Filed: Oct. 4, 2007

(65) Prior Publication Data

US 2008/0312912 A1 Dec. 18, 2008

(30) Foreign Application Priority Data

Jun. 12, 2007 (KR) ..... 10-2007-0057442

(51) Int. Cl.
*G10L 19/00* (2006.01)

(52) U.S. Cl. ..... 704/219; 704/500; 704/230; 341/54

(58) Field of Classification Search ..... 704/219, 704/230, 500; 341/54
See application file for complete search history.

(56) References Cited

U.S. PATENT DOCUMENTS

| | | | | |
|---|---|---|---|---|
| 5,619,197 | A * | 4/1997 | Nakamura | 341/50 |
| 7,548,853 | B2 * | 6/2009 | Shmunk et al. | 704/219 |
| 7,656,319 | B2 * | 2/2010 | Yu et al. | 341/52 |
| 2004/0024593 | A1 * | 2/2004 | Tsuji et al. | 704/215 |
| 2006/0015328 | A1 * | 1/2006 | Van Schijndel et al. | 704/219 |

* cited by examiner

*Primary Examiner* — Daniel D Abebe
(74) *Attorney, Agent, or Firm* — Stanzione & Kim, LLP

(57) ABSTRACT

Provided is an audio signal encoding method including transforming an input signal from a time domain to a time/frequency domain using a first transformation method, extracting a stereo parameter from a signal of the time/frequency domain, encoding the stereo parameter, and down-mixing the signal of the time/frequency domain, transforming each of sub-bands of the down-mixed signal to a frequency domain by using a second transformation method, and encoding the signal of the frequency domain in the frequency domain.

20 Claims, 12 Drawing Sheets

AUDIO SIGNAL ENCODING/DECODING METHOD AND APPARATUS

CROSS-REFERENCE TO RELATED APPLICATIONS

This application claims the benefit of Korean Patent Application No. 10-2007-0057442, filed on Jun. 12, 2007, in the Korean Intellectual Property Office, the disclosure of which is incorporated herein in its entirety by reference.

BACKGROUND

1. Field

One or more embodiments of the present invention relate to a method of encoding and decoding an audio signal.

2. Description of the Related Art

Conventional audio signal encoding apparatuses transform an audio signal from the time domain by using a predetermined method and encode the audio signal of the transformed domain by using another predetermined method. For example, conventional audio signal encoding apparatuses extract a predetermined parameter from the audio signal of the transformed domain, and quantize the audio signal in the transformed domain. Conventional audio signal encoding apparatuses include a plurality of tools having different functions. The plurality of tools processes audio signals of different domains.

However, conventional audio signal encoding apparatuses transform an input audio signal from a domain by using a plurality of methods irrespective of the domain of the input audio signal processed by each tool. For example, conventional audio signal encoding apparatuses in parallel transform the input audio signal from the time domain to a frequency domain and to a time/frequency domain. Therefore, conventional audio signal encoding apparatuses need much calculation in order to transform the input audio signal from the domain, which increases an encoding delay as a whole and reduces encoding efficiency.

SUMMARY

One or more embodiments of the present invention provides an audio signal encoding method and apparatus capable of increasing encoding efficiency by reducing much calculation for transforming an input audio signal from a domain in order to encode the audio signal.

One or more embodiments of the present invention also provides an audio signal decoding method and apparatus capable of increasing decoding efficiency by reducing much calculation for transforming an input audio bit stream from a domain in order to decode the audio bit streams.

Additional aspects and utilities of the present general inventive concept will be set forth in part in the description which follows and, in part, will be obvious from the description, or may be learned by practice of the general inventive concept.

According to an aspect of the present invention, there is provided an audio signal encoding method comprising: transforming an input signal from a time domain to a time/frequency domain using a first transformation method; extracting a stereo parameter from a signal of the time/frequency domain, encoding the stereo parameter, and down-mixing the signal of the time/frequency domain; transforming each of sub-bands of the down-mixed signal to a frequency domain by using a second transformation method; and encoding the signal of the frequency domain in the frequency domain.

According to another aspect of the present invention, there is provided a method of decoding an audio bitstream including a result of encoding in a frequency domain of an encoding port and an encoded stereo parameter, the method comprising: decoding the result of encoding in a frequency domain in the frequency domain; inverse-transforming the decoded signal from the frequency domain to a time/frequency domain using a first inverse transformation method; decoding an encoded stereo parameter and up-mixing the signal of the time/frequency signal as a stereo signal; and inverse-transforming the stereo signal to the time domain using a second inverse transformation method.

According to another aspect of the present invention, there is provided a method of decoding and audio bitstream including a result of encoding in a frequency domain of an encoding port and an encoded high frequency band parameter, the method comprising: decoding the result of encoding in a frequency domain in the frequency domain; and inverse-transforming the decoded signal from the frequency domain to a time/frequency domain using a first inverse transformation method.

According to another aspect of the present invention, there is provided a method of decoding an audio bitstream including a result of encoding in a frequency domain of an encoding port and an encoded high frequency band parameter, the method comprising: decoding the result of encoding in a frequency domain in the frequency domain; inverse-transforming the decoded signal from the frequency domain to a time/frequency domain using a first inverse transformation method; decoding an encoded high frequency band parameter and generating a high frequency band signal based on a low frequency band signal of the time/frequency domain; and inverse-transforming the signals of the time/frequency domain and the high frequency band signal to the time domain using a second inverse transformation method.

According to another aspect of the present invention, there is provided an apparatus for decoding an audio bitstream including a result of encoding in a frequency domain of an encoding port and an encoded stereo parameter, the apparatus comprising: a frequency domain decoding unit decoding the result of encoding in a frequency domain in the frequency domain; a first domain inverse transforming unit inverse-transforming the decoded signal from the frequency domain to a time/frequency domain using a first inverse transformation method; a stereo decoding unit decoding an encoded stereo parameter and up-mixing the signal of the time/frequency signal as a stereo signal; and a second domain inverse transforming unit inverse-transforming the stereo signal to the time domain using a second inverse transformation method.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE PREFERRED EMBODIMENTS

Figure 1:
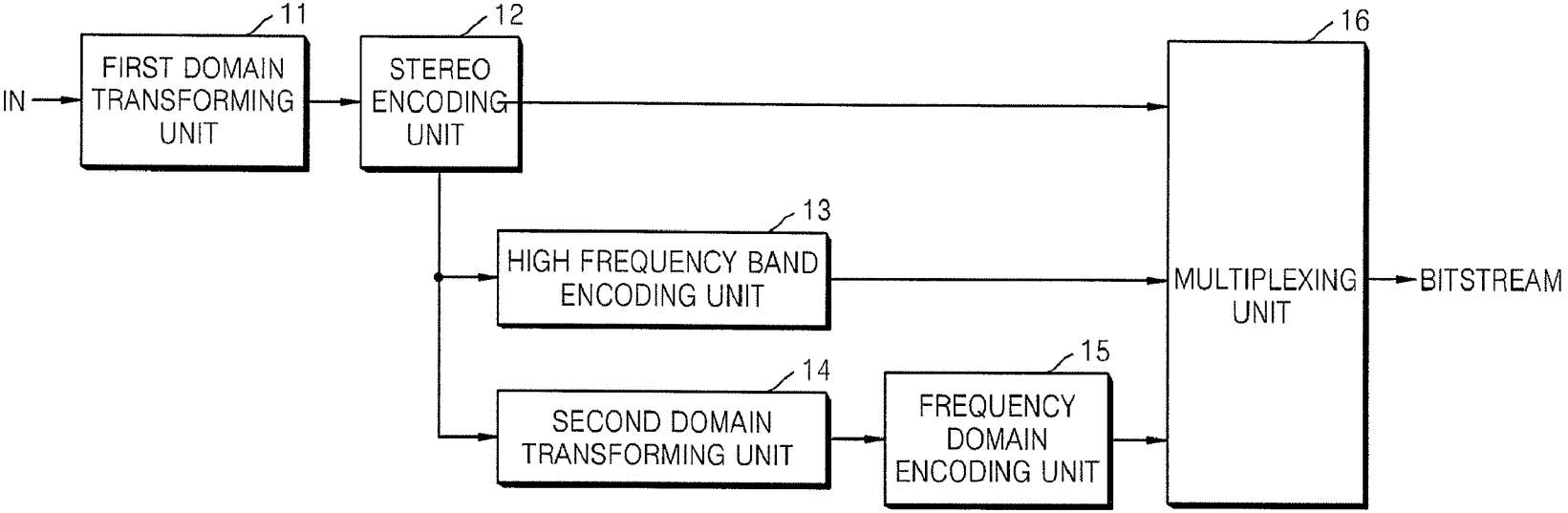
FIG. 1 is a block diagram of an audio signal encoding apparatus according to an embodiment of the present invention.

The present invention will now be described more fully with reference to the accompanying drawings, in which exemplary embodiments of the invention are shown. This invention may, however, be embodied in many different forms and should not be construed as being limited to the embodiments set forth herein; rather, these embodiments are provided so that this disclosure will be thorough and complete, and will fully convey the concept of the invention to those of ordinary skill in the art. Like reference numerals in the drawings denote like elements, and thus their description will be omitted.

Unless otherwise defined, all terms (including technical and scientific terms) used herein have the same meaning as commonly understood by one of ordinary skill in the art to which this invention pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram of an audio signal encoding apparatus according to an embodiment of the present invention. Referring to FIG. 1, the audio signal encoding apparatus comprises a first domain transforming unit 11, a stereo encoding unit 12, a high frequency band encoding unit 13, a second domain transforming unit 14, a frequency domain encoding unit 15, and a multiplexing unit 16.

The first domain transforming unit 11 receives an input signal IN and transforms the input signal IN from a time domain to a time/frequency domain using a first transformation method. The input signal IN can be a pulse code modulation (PCM) signal that is a digital signal of an analog speech signal or an analog audio signal. The time domain indicates the amplitude (e.g., energy, sound pressure, etc.) of the input signal IN as time elapses, whereas the frequency domain indicates the spectral content of the input signal IN as frequency varies. The time/frequency domain indicates the spectral content of the input signal IN, by way of its component frequencies, as time elapses. In more detail, the first domain transforming unit 11 transforms the input signal IN from the time domain to the time/frequency domain and represents the spectral content of the input signal IN in a domain of both time and frequency.

The first transformation method can be an extended lapped transformation (ELT). The ELT overlaps a basis function so as to reduce a blocking effect that exists at a boundary of blocks, and can be realized as a cosine modulated filter bank. In this regard, the ELT is expressed as Equation 1 below, $$h_k(n) = w(n)\sqrt{\frac{2}{M}}\cos\left[\frac{\pi}{M}\left(k+\frac{1}{2}\right)\left(n+\frac{M+1}{2}\right)\right] \tag{1}$$

wherein, h(n) denotes a transformation function using the ELT method, w(n) denotes a low pass filter function, n is an integer number greater than 1, M denotes the number of channels, and k denotes an overlapping factor. When the size of a window is L, the overlapping factor k can be L/2M. Modulated lapped transformation (MLT), which is one of lapped transformation methods, can be applied when the overlapping factor k is 1, whereas the ELT can be applied irrespective of a value of the overlapping factor k.

In more detail, the first transformation method may be a complex ELT (CELT) which is a transformation method in a manner of an extended complex exponential function. The CELT can be realized as the cosine modulated filter bank and a sine modulated filter bank, and is expressed as Equation 2 below, $$h_k(n) = w(n)\sqrt{\frac{2}{M}}\exp\left[j\frac{\pi}{M}\left(k+\frac{1}{2}\right)\left(n+\frac{M+1}{2}\right)\right] \tag{2}$$

wherein, h(n) denotes a transformation function using the ELT method, w(n) denotes a low pass filter function, n is an integer number greater than 1, M denotes the number of channels, and k denotes an overlapping factor. When the size of a window is L, the overlapping factor k can be L/2M. As mentioned above, the ELT can be applied when the overlapping factor k is 1, whereas the CELT can be applied irrespective of a value of the overlapping factor k.

In more detail, the first domain transforming unit 11 performs the CELT with regard to the input signal IN and transforms the input signal IN from the time domain to the time/frequency domain, thereby generating a first signal expressed as a real part and a second signal expressed as an imaginary part. The first signal expressed as the real part and the second signal expressed as the imaginary part are input into the stereo encoding unit 12 and the high frequency band encoding unit 13 to measure energy, or into a psychoacoustic model (not shown) to encode a low frequency band signal. The psychoacoustic model is a mathematical model of an acoustic response function of the human auditory system.

The stereo encoding unit 12 extracts a stereo parameter from the signal of the time/frequency domain, encodes the stereo parameter, and down-mixes the signal of the time/frequency domain. The down-mixing of the signals results in the generation of a one-channel mono signal from a two or more channel stereo signal, thereby reducing a bit rate allocated to a signal encoding process.

In more detail, the stereo encoding unit 12 extracts the stereo parameter indicating side information on the stereo signal from the signal of the time/frequency domain and encodes the stereo parameter, thereby delivering a representation of the stereo signal indicating the channel characteristics of the stereo signal. It can be understood by those of ordinary skill in the art that the side information on the stereo signal can include various pieces of information such as an inter-channel intensity difference and an inter-channel phase difference of a left channel signal and a right channel signal.

The stereo parameter extracted from the stereo encoding unit 12 can be information necessary for up-mixing the mono signal transmitted from an encoding port to the stereo signal in a decoding port. The up-mixing is complimentary to the down-mixing and results in the generation of the two- or more channel stereo signal from the mono signal.

For example, the stereo encoding unit 12 can be realized using high efficiency-advanced audio coding (HE-AAC) parametric stereo (PS) technology. The PS technology relates to parametric encoding of the mono signal and the 2-channel stereo signal based on the parameter side information. In the PS technology, three space parameters such as an inter-channel intensity difference, an inter-channel phase difference, and an inter-channel coherence, are induced. An auditory space diffusion or space density of a sound stage can be parametric by an extended subset of the space parameters due to the inter-channel coherence.

However, this is merely one of the embodiments of the present invention and it can be understood by those of ordinary skill in the art that the input signal IN may be the mono signal and the audio signal encoding apparatus may not include the stereo encoding unit 12 according to another embodiment of the present invention. In this case, the high frequency band encoding unit 13 and the second domain transforming unit 14 can receive the signal of the time/frequency domain.

The high frequency band encoding unit 13 extracts a high frequency band parameter from a high frequency band signal that corresponds to a frequency band greater than a predetermined threshold value of the down-mixed signals, and encodes the high frequency band parameter. In more detail, the high frequency band encoding unit 13 analyzes the high frequency band signal from the down-mixed signal, extracts the high frequency band parameter indicating side information on the high frequency band signal from the high frequency band signal, and encodes the high frequency band parameter. It can be understood by those of ordinary skill in the art that the side information on the high frequency band signal includes various pieces of information such as an energy level or an envelope curve or the like of the high frequency band signal.

The audio signal encoding apparatus can encode and transmit the high frequency band parameter and encode a low frequency band signal without encoding the high frequency band signal, and generate the high frequency band signal using results obtained by decoding the encoded high frequency band parameter and the encoded low frequency band signal.

For example, the high frequency band encoding unit 13 can be realized using HE-AAC spectral band replication (SBR) technology. The SBR technology estimates a component of a high frequency band using information in a low frequency band on the assumption that there is a close relationship between the high frequency band and the low frequency band of the audio signal. The SBR technology performs a transposition process of copying low frequency spectrum data to the high frequency band, and adjusts the shape of the high frequency band using a spectrum envelope curve of an original audio signal having a complete spectrum and additional information necessary for compensating a high frequency component that is likely to be excluded in the transposition process.

However, this is merely one of the embodiments of the present invention and it can be understood by those of ordinary skill in the art that the audio signal encoding apparatus may not include the high frequency band encoding unit 13 according to another embodiment of the present invention. In this case, the frequency domain encoding unit 15 can encode the low frequency band signal and the high frequency band signal.

The second domain transforming unit 14 transforms each sub-band of the down-mixed signal to the frequency domain using the second transformation method. In this case, the second transformation method may be modified discrete cosine transformation (MDCT) that is used to transform each sub-band of the down-mixed signal to the frequency domain.

The conventional audio signal encoding apparatus transforms in parallel an input signal from a time domain to a time/frequency domain and to the frequency domain. In more detail, the conventional audio signal encoding apparatus transforms the input signal from the time domain to the time/frequency domain and simultaneously transforms each sub-band of the input signal of the time domain to the frequency domain. In this case, the conventional audio signal encoding apparatus separately performs calculation of the signal of the time/frequency domain and the signal of the frequency domain, which increases the number of calculation and a delay as a whole.

However, the audio signal encoding apparatus of the present embodiment of the present invention serially transforms the input signal from the time domain to the time/frequency domain and from the time/frequency domain to the frequency domain. In this case, the audio signal encoding apparatus transforms each sub-band of the signal of the time/frequency domain to the frequency domain, which reduces the number of calculations and the corresponding delay as a whole.

The frequency domain encoding unit 15 encodes the signal of the frequency domain in the frequency domain. That is, the encoded signal is in the frequency domain, and produces frequency domain information when decoded.

The multiplexing unit 16 multiplexes the stereo parameter, the high frequency band parameter, and a result obtained by encoding the signal in the frequency domain, and generates a bitstream.

Figure 2:
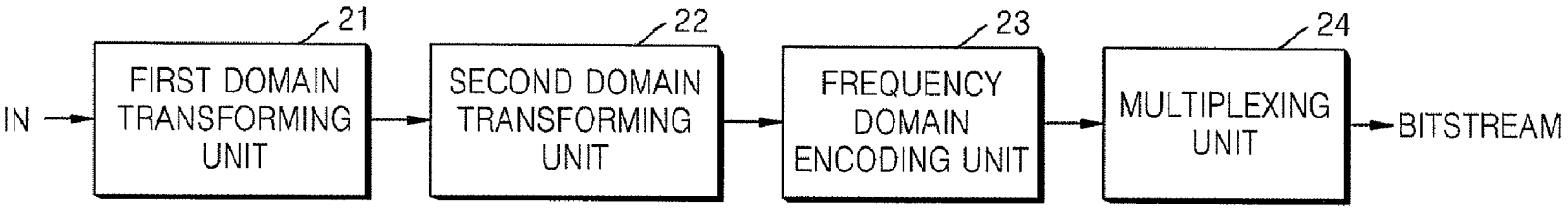
FIG. 2 is a block diagram of an audio signal encoding apparatus according to another embodiment of the present invention.

FIG. 2 is a block diagram of an audio signal encoding apparatus according to another embodiment of the present invention. Referring to FIG. 2, the audio signal encoding apparatus comprises a first domain transforming unit 21, a second domain transforming unit 22, a frequency domain encoding unit 23, and a multiplexing unit 24.

The first domain transforming unit 21 receives an input signal IN and transforms the input signal IN from a time domain to a time/frequency domain using a first transformation method. The input signal IN can be a PCM signal that is a digital signal of an analog speech signal or an analog audio signal. The first transformation method can be ELT. In more detail, the first transformation method may be CELT which is a transformation method in a manner of an extended complex exponential function. The explanations of the ELT and the CELT are the same as those given in regard to FIG. 1, and thus will not be repeated here.

The second domain transforming unit 22 transforms each sub-band of the signal of the time/frequency domain to the frequency domain using a second transformation method. In this case, the second transformation method may be MDCT.

The audio signal encoding apparatus of the present embodiment connects the first domain transforming unit 21 and the second domain transforming unit 22 in cascade, transforms the input signal IN from the time domain to the time/frequency domain, and to the frequency domain. That is, the audio signal encoding apparatus of the present embodiment performs the MDCT with regard to each sub-band of the signal of the time/frequency domain and transforms each sub-band to the frequency domain, thereby reducing the number of calculation and simultaneously a frequency resolution so that encoding efficiency can be increased in the frequency domain. The frequency resolution is the density of resolvable frequencies of a signal in the frequency domain.

The frequency domain encoding unit 23 encodes the signal of the frequency domain in the frequency domain.

The multiplexing unit 24 multiplexes a result obtained by encoding the signal of the frequency domain in the frequency domain, and generates a bitstream.

Figure 3:
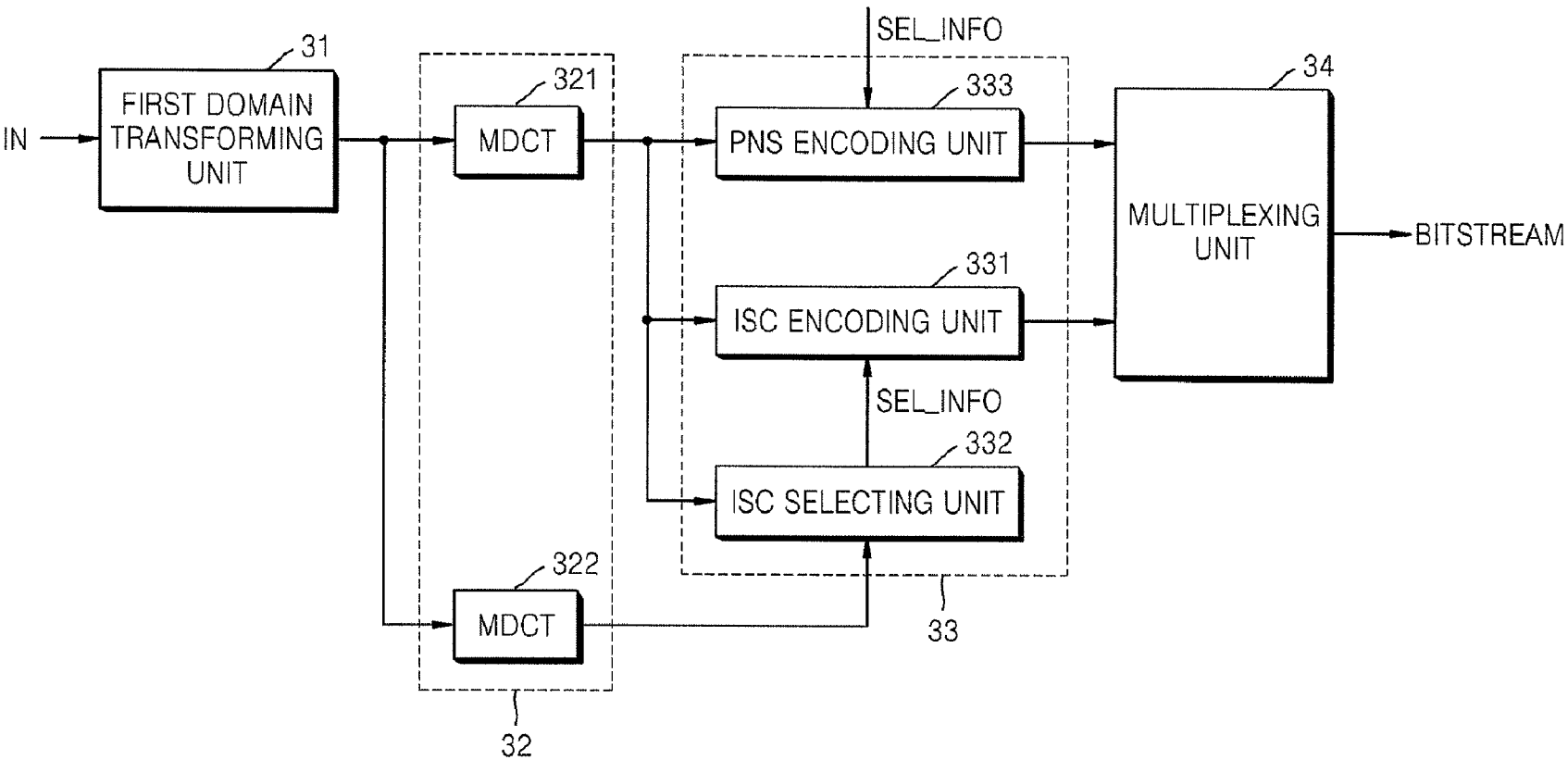
FIG. 3 is a detailed block diagram of the audio signal encoding apparatus shown in FIG. 2.

FIG. 3 is a detailed block diagram of the audio signal encoding apparatus shown in FIG. 2. Referring to FIG. 3, the audio signal encoding apparatus comprises a first domain transforming unit 31, a second domain transforming unit 32, a frequency domain encoding unit 33, and a multiplexing unit 34. The second domain transforming unit 32 comprises a first MDCT performing unit 321 and a second MDCT performing unit 322. The frequency domain encoding unit 33 comprises an important spectral components (ISCs) encoding unit 331, an ISCs selecting unit 332, and a perceptual noise substitution (PNS) encoding unit 333.

The first domain transforming unit 31 receives the input signal IN and transforms the input signal IN from the time domain to the time/frequency domain. The input signal IN can be a PCM signal that is a digital signal of an analog speech signal or an analog audio signal. The time/frequency domain indicates the size of the input signal IN as time elapses and as the frequency varies. The first transformation method can be ELT, and may be CELT which is a transformation method in a manner of an extended complex exponential function. In more detail, the first domain transforming unit 31 performs the CELT with regard to the input signal IN and transforms the input signal IN from the time domain to the time/frequency domain, thereby generating a first signal expressed as a real part and a second signal expressed as an imaginary part.

The first MDCT performing unit 321 and the second MDCT performing unit 322 of the second domain transforming unit 32 perform MDCT with regard to each sub-band of the first signal and the second signal, respectively, and transform each sub-band from the time/frequency domain to the frequency domain, and generate third and fourth signals, respectively. The second domain transforming unit 32 performs MDCT with regard to each sub-band of the first signal expressed as the real part and the second signal expressed as the imaginary part, and thus amplitude and phase information can be obtained. This is the same result as obtained by performing Fast Fourier Transformation (FFT), thereby increasing encoding performance.

The frequency domain encoding unit 33 encodes the signal of the frequency domain in the frequency domain.

The ISC selecting unit 332 of the frequency domain encoding unit 33 selects ISCs greater than a predetermined value from frequency spectral components of the second signal using the fourth signal and provides the ISC encoding unit 331 with selection information SEL_INFO.

For example, the ISC selecting unit 332 selects ISC from frequency spectral components using the following methods. First, the ISC selecting unit 332 calculates a signal-to-mask ratio (SMR) value allocated by applying a psychoacoustic model that removes perceptive redundancy caused by a human auditory property, and selects signals greater than a masking threshold value as ISC. Second, the ISC selecting unit 332 extracts spectral peaks based on a predetermined weight and selects ISC from spectrum peaks. Third, the ISC selecting unit 332 calculates a signal-to-noise ratio (SNR) value with regard to each sub-band and selects frequency components having peak values greater than a predetermined value as ISC. These three methods can be separately used or a combination of two or more methods can be used.

The ISC encoding unit 331 performs ISC encoding in which the ISCs are selected from frequency spectrum components of the third signal using the selection information SEL_INFO, so that the number of encoding bits is reduced in the frequency domain, thereby increasing encoding efficiency.

The PNS encoding unit 333 encodes residual spectral components in which the ISCs are removed from the frequency spectrum components of the third signal using the selection information SEL_INFO. For example, the PNS encoding unit 333 performs PNS so as to detect an envelope of the residual spectral components. In more detail, PNS encoding is performed in which an encoder detects a noise envelope from high frequency components and a decoder inserts a random noise into the high frequency components and restores the high frequency components. In more detail, the PNS encoding unit 333 calculates a noise level of residual spectral components of each sub-band and quantizes the noise level, which increases compression efficiency of noise components.

The noise level can be calculated by performing a linear prediction analysis. The linear prediction analysis is performed using an autocorrelation method and furthermore, a covariance method, a Durbin's method or the like. An encoder predicts the noise components of a current frame by performing the linear prediction analysis. If the amount of noise is relatively large, all of the noise components are transmitted. If the amount of noise is relatively small and the amount of tone components is relatively large, the noise information is reduced and transmitted. In a small window, since noise rapidly changes, the noise information is reduced and transmitted.

The multiplexing unit 34 multiplexes a result obtained by encoding the frequency domain signal and generates the bitstream. In more detail, the multiplexing unit 34 multiplexes a result obtained by ISC encoding performed by the ISC encoding unit 331 and the residual spectral components encoded by the PNS encoding unit 333 and generates the bitstream.

Figure 4:
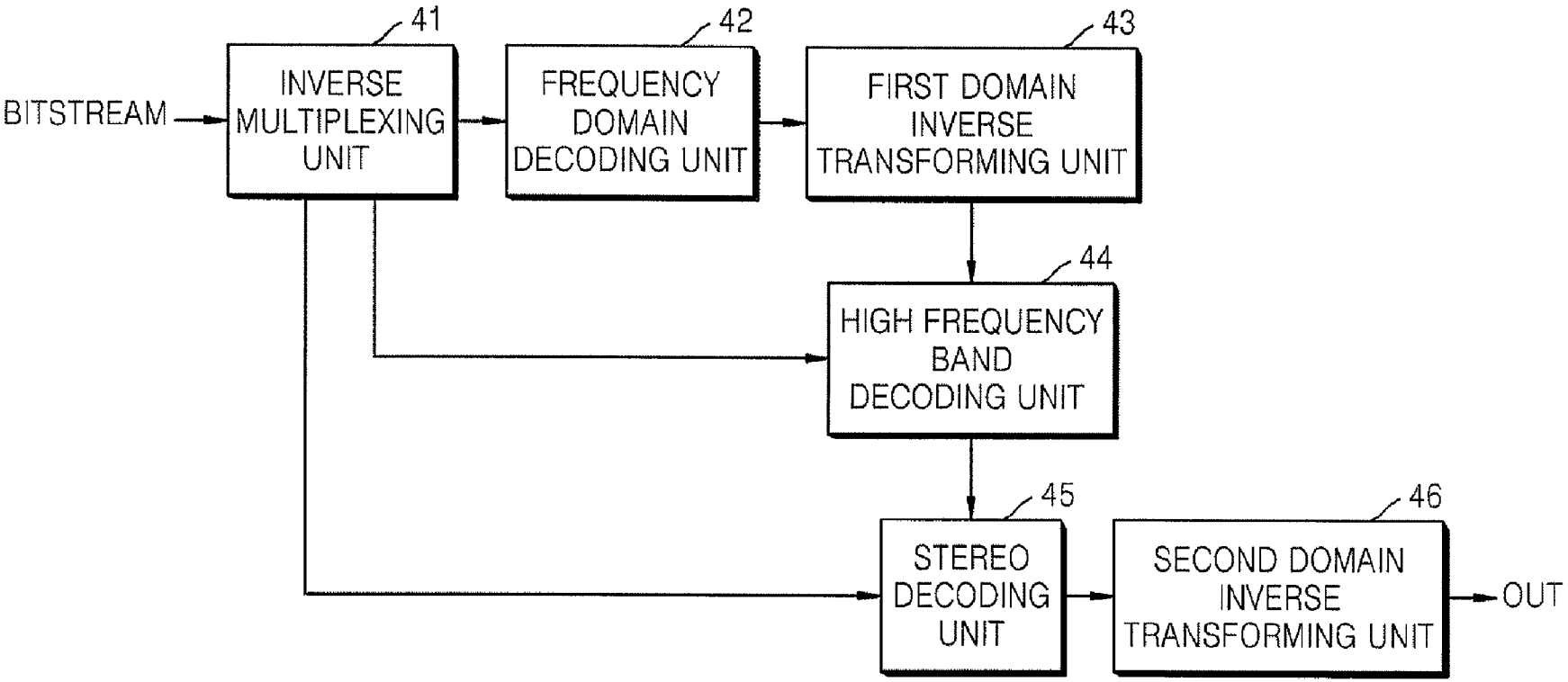
FIG. 4 is a block diagram of an audio signal decoding apparatus according to an embodiment of the present invention.

FIG. 4 is a block diagram of an audio signal decoding apparatus according to an embodiment of the present invention. Referring to FIG. 4, the audio signal decoding apparatus comprises an inverse multiplexing unit 41, a frequency domain decoding unit 42, a first domain inverse transforming unit 43, a high frequency band decoding unit 44, a stereo decoding unit 45, and a second domain inverse transforming unit 46.

The inverse multiplexing unit 41 receives a bitstream transmitted from an encoding port and inverse-multiplexes the bitstream. The inverse multiplexing unit 41 may output data including results obtained by encoding the signal in a frequency domain of the encoding port, a stereo parameter, and a high frequency band parameter.

The frequency domain decoding unit 42 decodes the result obtained by encoding the signal in the frequency domain of the encoding port in the frequency domain from the inverse multiplexing unit 41.

The first domain inverse transforming unit 43 inverse-transforms a decoding result obtained from the frequency domain decoding unit 42 from the frequency domain to a time/frequency domain using a first inverse transformation method. The first inverse transformation method is to inversely transform the second transformation method described above, for example, inverse MDCT (IMDCT).

The high frequency band decoding unit 44 decodes the result obtained by encoding the high frequency band parameter received from the inverse multiplexing unit 41 and generates a high frequency band signal based on a low frequency band signal in the time/frequency domain that is output by the first domain inverse transforming unit 43. However, this is just one of the embodiments of the present invention. If the encoding port does not extract the high frequency band parameter, the audio signal decoding apparatus may not comprise the high frequency band decoding unit 44, but the frequency domain decoding unit 42 can separately decode the low frequency band signal and the high frequency band signal.

The stereo decoding unit 45 up-mixes a mono signal decoded by the high frequency band decoding unit 44 as a stereo signal using the result obtained by encoding the stereo parameter received from the inverse multiplexing unit 41. However, this is just one of the embodiments of the present invention. If the mono signal is input into the encoding port, the audio signal decoding apparatus may not comprise the stereo decoding unit 45.

The second domain inverse transforming unit 46 inverse-transforms the up-mixed stereo signal from the time/frequency domain to the time domain using a second inverse transformation method. The second inverse transformation method is to inversely transform the result of the first transformation method described above, for example, inverse CELT (ICELT).

Figure 5:
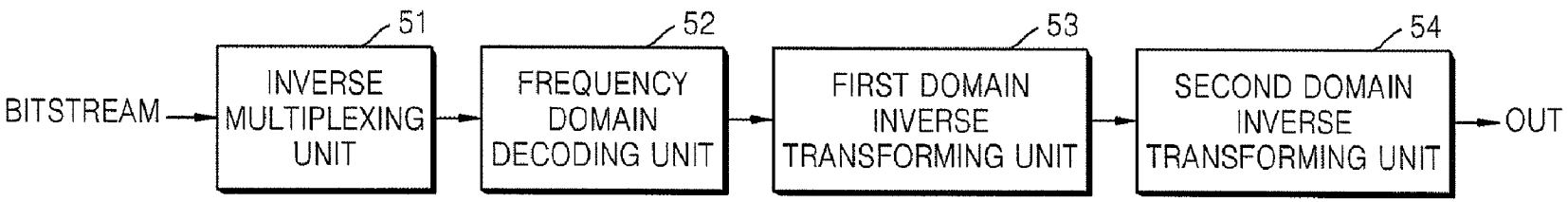
FIG. 5 is a block diagram of an audio signal decoding apparatus according to another embodiment of the present invention.

FIG. 5 is a block diagram of an audio signal decoding apparatus according to another embodiment of the present invention. Referring to FIG. 5, the audio signal decoding apparatus comprises an inverse multiplexing unit 51, a frequency domain decoding unit 52, a first domain inverse transforming unit 53, and a second domain inverse transforming unit 54.

The inverse multiplexing unit 51 receives a bitstream transmitted from an encoding port, inverse-multiplexes the bitstream, and outputs a result of encoding in a frequency domain of the encoding port.

The frequency domain decoding unit 52 decodes the result of encoding in the frequency domain of the encoding port that is output by the inverse multiplexing unit 51 in the frequency domain.

The first domain inverse transforming unit 53 inverse-transforms a decoding result output by the frequency domain decoding unit 52 from the frequency domain to a time/frequency domain using a first inverse transformation method. The first inverse transformation method is to inversely transform the result of the second transformation method described above, for example, IMDCT.

The second domain inverse transforming unit 54 inverse-transforms a signal received from the first domain inverse transforming unit 53 from the time/frequency domain to the time domain using a second inverse transformation method. The second inverse transformation method is to inversely transform the result of the first transformation method described above, for example, ICELT.

Figure 6:
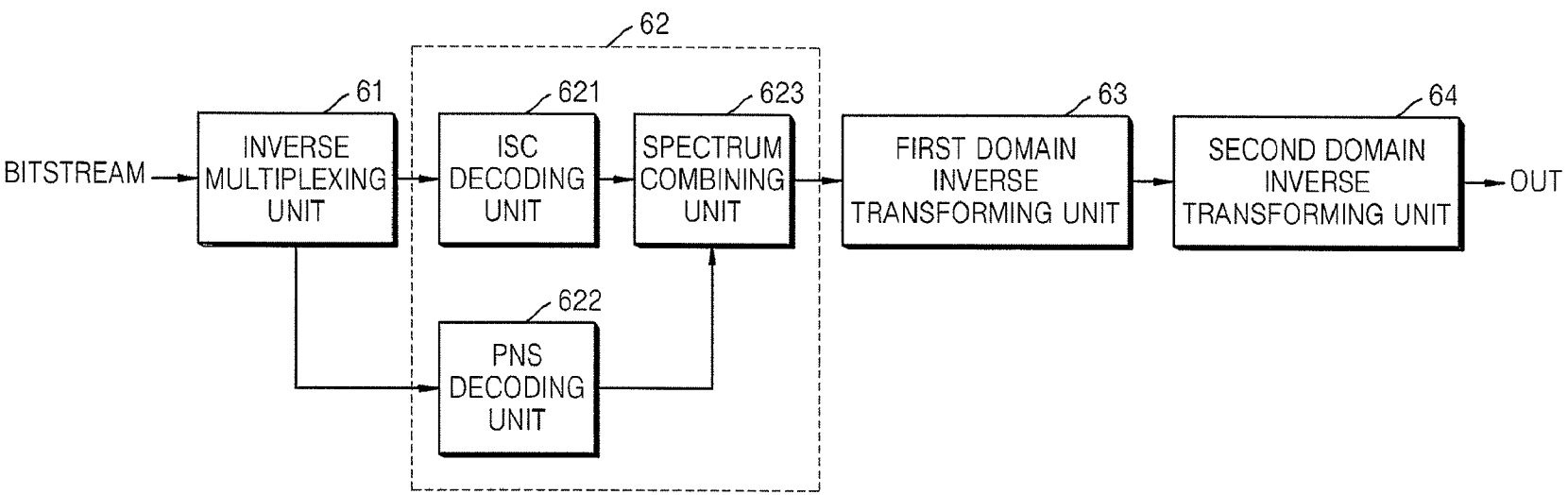
FIG. 6 is a detailed block diagram of the audio signal decoding apparatus shown in FIG. 5.

FIG. 6 is a detailed block diagram of the audio signal decoding apparatus shown in FIG. 5. Referring to FIG. 6, the audio signal decoding apparatus comprises an inverse multiplexing unit 61, a frequency domain decoding unit 62, a first domain inverse transforming unit 63, and a second domain inverse transforming unit 64. The frequency domain decoding unit 62 comprises an ISC decoding unit 621, a PNS decoding unit 622, and a spectrum combining unit 623.

The inverse multiplexing unit 61 receives the bitstream transmitted from the encoding port and inverse-multiplexes the bitstream. The inverse multiplexing unit 61 may output data including results obtained by quantizing ISCs and a noise level of the residual spectral components as results encoded in the frequency domain of the encoding port.

The ISC decoding unit 621 decodes the encoded ISCs. The PNS decoding unit 622 decodes the noise from the encoded residual spectral components. The spectrum combining unit 623 combines the result of ISC decoding performed by the ISC decoding unit 621 and the residual spectral components decoded by the PNS decoding unit 622.

The first domain inverse transforming unit 63 inverse-transforms a signal received from the spectrum combining unit 623 from the frequency domain to the time/frequency domain using a first inverse transformation method. The first inverse transformation method is to inversely transform the result of the second transformation method described above, for example, IMDCT.

The second domain inverse transforming unit 64 inverse-transforms a signal received from the first domain inverse transforming unit 63 from the time/frequency domain to the time domain using a second inverse transformation method. The second inverse transformation method is to inversely transform the result of the first transformation method described above, for example, ICELT.

Figure 7:
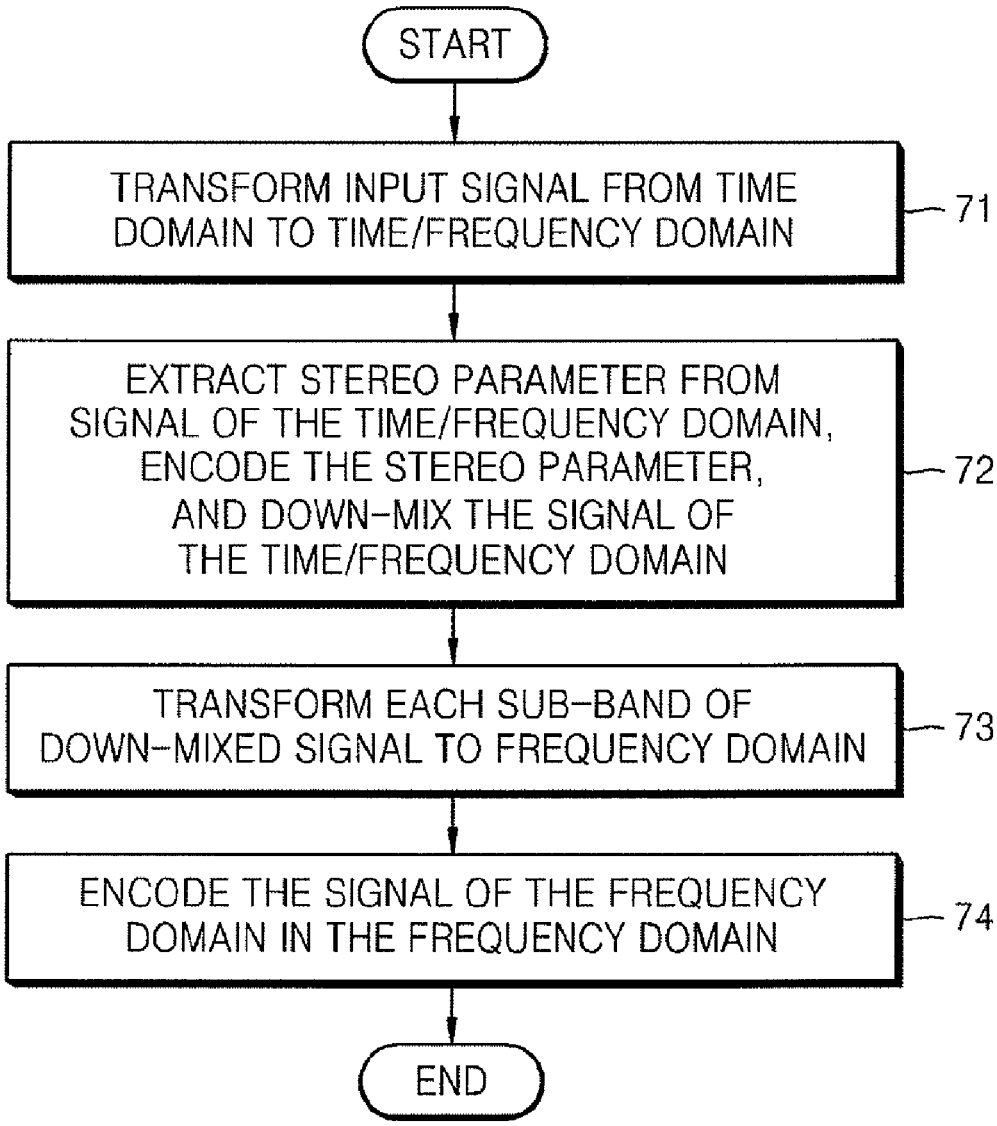
FIG. 7 is a flowchart of an audio signal encoding method according to an embodiment of the present invention.

FIG. 7 is a flowchart of an audio signal encoding method according to an embodiment of the present invention. Referring to FIG. 7, the audio signal encoding method comprises time serial operations performed in the audio signal encoding apparatus shown in FIG. 1. Thus, although it is not described in the present embodiment, the description of the audio signal encoding apparatus shown in FIG. 1 is applied to the audio signal encoding method of the present embodiment.

In operation 71, the first domain transforming unit 11 transforms an input signal IN from the time domain to the time/frequency domain using a first transformation method. In more detail, the first domain transforming unit 11 uses the first transformation method in a manner of a complex exponential function and generates a first signal expressed as a real part of the time/frequency domain and a second signal expressed as an imaginary part of the time/frequency domain.

In operation 72, the stereo encoding unit 12 extracts a stereo parameter from the signal of the time/frequency domain, encodes the stereo parameter, and down-mixes the signal of the time/frequency domain. In more detail, the stereo encoding unit 12 extracts the stereo parameter from each of the first and second signals and down-mixes each of the first and second signals.

In operation 73, the second domain transforming unit 14 transforms each sub-band of the down-mixed signal to the frequency domain using a second transformation method. In more detail, the second domain transforming unit 14 uses the second transformation method to generate a third signal of the frequency domain from each sub-band of the down-mixed first signal, and a fourth signal of the frequency domain from each sub-band of the down-mixed second signal.

In operation 74, the frequency domain encoding unit 15 encodes the signal of the frequency domain in the frequency domain. In more detail, the frequency domain encoding unit 15 selects ISCs from the third signal using the fourth signal and encodes the ISCs, and encodes residual spectral components in which the ISCs are removed from the third signal.

In this case, the audio signal encoding method further comprises an operation in that the multiplexing unit 16 multiplexes the encoded stereo parameter, a result obtained by performing the ISC encoding, and a result obtained by encoding the residual spectral components, and generates a bitstream.

The audio signal encoding method further comprises an operation in that the high frequency band encoding unit 13 extracts a high frequency band parameter from a high frequency band signal that corresponds to a frequency band greater than a predetermined threshold value of the downmixed signal and encodes the high frequency band parameter. In this case, the audio signal encoding method further comprises an operation in which the multiplexing unit 16 multiplexes the encoded stereo parameter, a result obtained by encoding the signal of the frequency domain in the frequency domain, and the encoded high frequency band parameter, and generates a bitstream.

Figure 8:
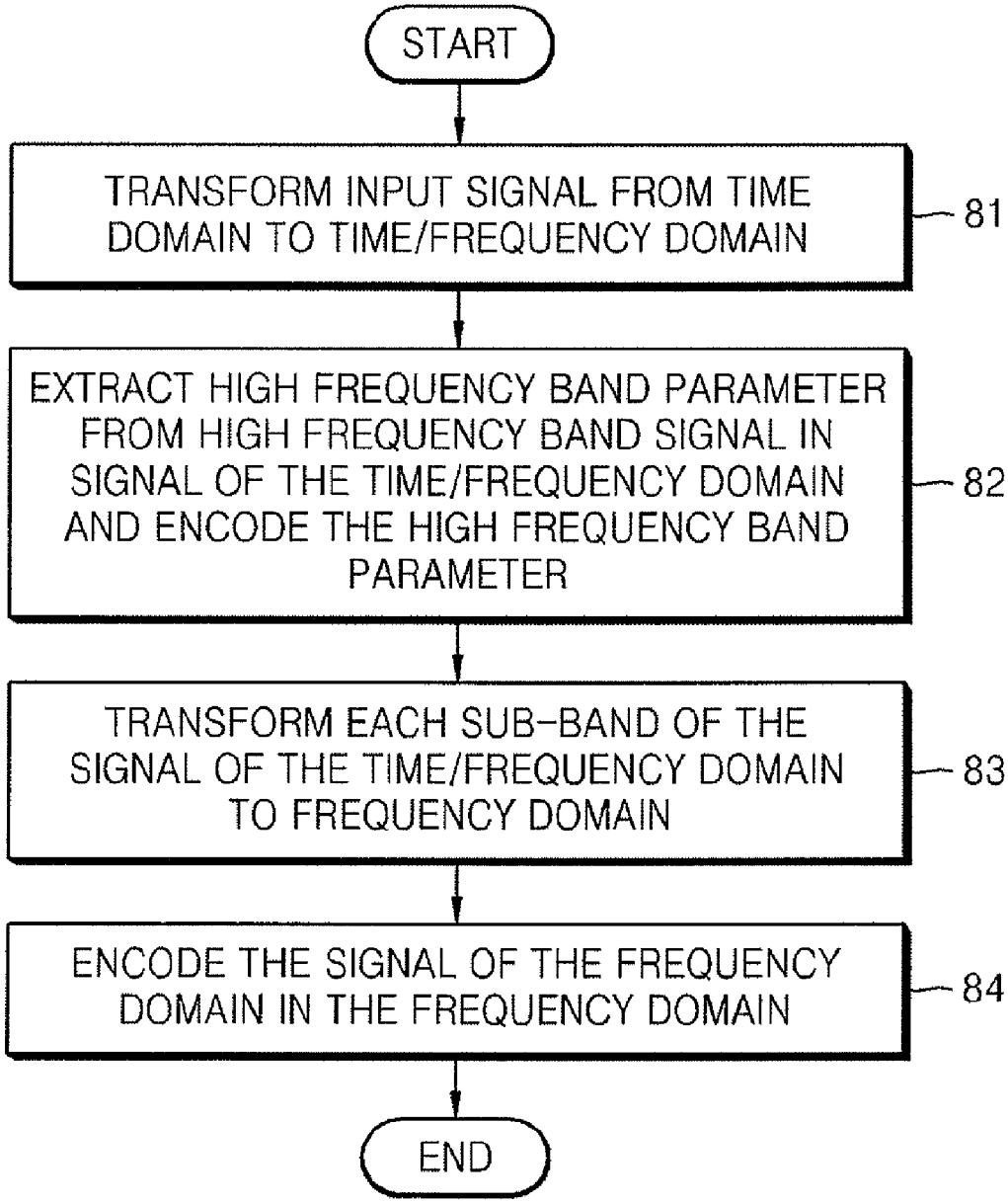
FIG. 8 is a flowchart of an audio signal encoding method according to another embodiment of the present invention.

FIG. 8 is a flowchart of an audio signal encoding method according to another embodiment of the present invention. Referring to FIG. 8, the audio signal encoding method comprises time serial operations performed in the audio signal encoding apparatus shown in FIG. 2. Thus, although it is not described in the present embodiment, the description of the audio signal encoding apparatus shown in FIG. 2 is applied to the audio signal encoding method of the present embodiment.

In operation 81, the first domain transforming unit 11 transforms an input signal IN from the time domain to the time/frequency domain using a first transformation method. In more detail, the first domain transforming unit 11 uses the first transformation method in a manner of a complex exponential function and generates a first signal expressed as a real part of the time/frequency domain and a second signal expressed as an imaginary part of the time/frequency domain.

In operation 82, the high frequency band encoding unit 13 extracts a high frequency band parameter from a high frequency band signal that corresponds to a frequency band greater than a predetermined threshold value of the signal of the time/frequency domain and encodes the high frequency band parameter. In more detail, the high frequency band encoding unit 13 analyzes the high frequency band signal from each of the first and second signals, extracts the high frequency band parameter, and encodes the high frequency band parameter.

In operation 83, the second domain transforming unit 14 transforms each sub-band of the signal of the time/frequency domain to the frequency domain using a second transformation method. In more detail, the second domain transforming unit 14 uses the second transformation method to generate a third signal of the frequency domain from each sub-band of the first signal, and a fourth signal of the frequency domain from each sub-band of the second signal.

In operation 84, the frequency domain encoding unit 15 encodes the signal of the frequency domain in the frequency domain. In more detail, the frequency domain encoding unit 15 selects ISCs from the third signal using the fourth signal and encodes the ISCs, and encodes residual spectral components in which the ISCs are removed from the third signal.

In this case, the audio signal encoding method further comprises an operation in that the multiplexing unit 16 multiplexes the encoded stereo parameter, a result obtained by performing the ISC encoding, and the encoded residual spectral components, and generates a bitstream.

The audio signal encoding method further comprises an operation in that the multiplexing unit 16 multiplexes the encoded stereo parameter, and a result obtained by encoding the signal of the frequency domain in the frequency domain, and generates a bitstream.

Figure 9:
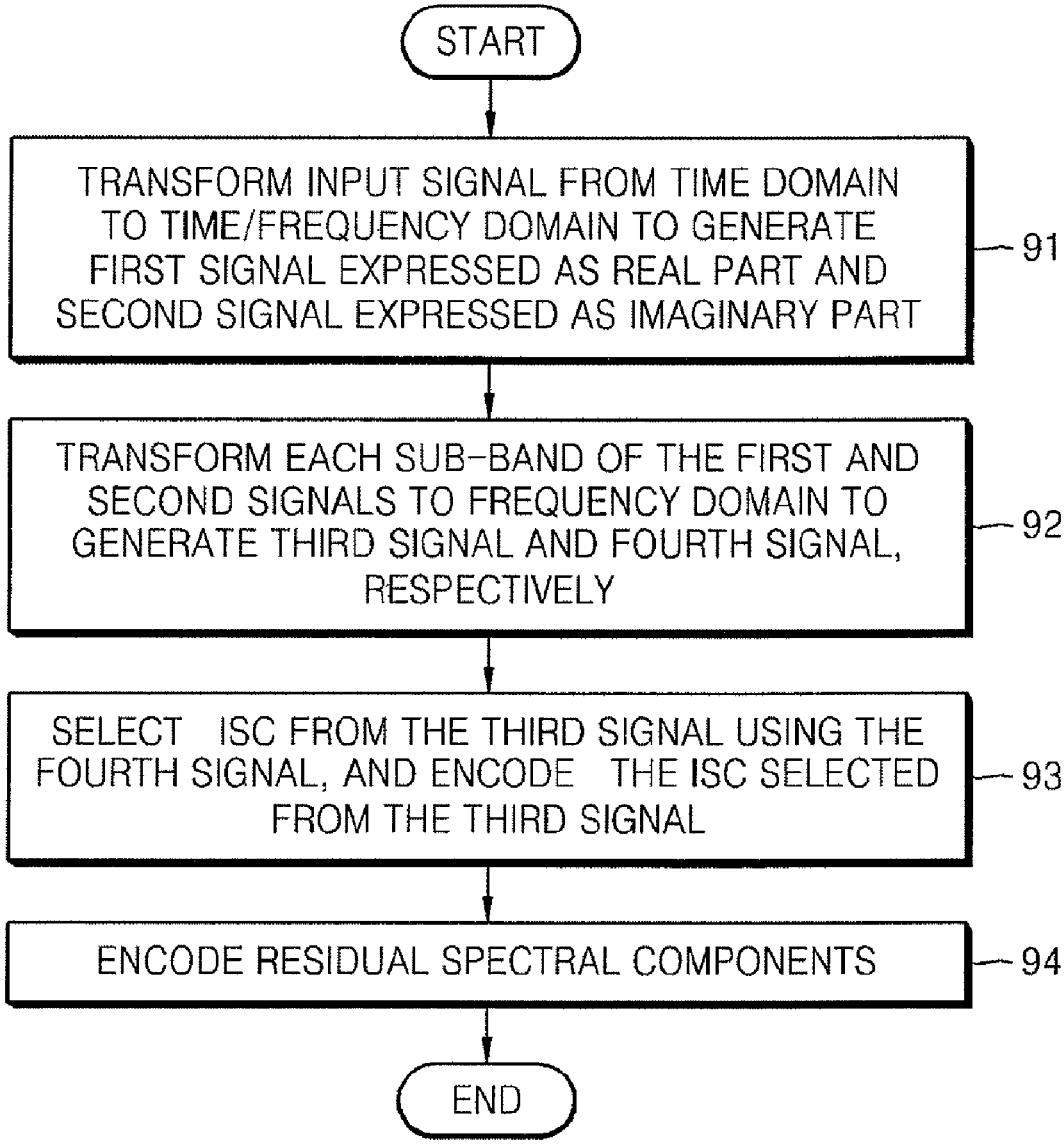
FIG. 9 is a flowchart of an audio signal encoding method according to another embodiment of the present invention.

FIG. 9 is a flowchart of an audio signal encoding method according to another embodiment of the present invention. Referring to FIG. 9, the audio signal encoding method comprises time serial operations performed in the audio signal encoding apparatus shown in FIG. 3. Thus, although it is not described in the present embodiment, the description of the audio signal encoding apparatus shown in FIG. 3 is applied to the audio signal encoding method of the present embodiment.

In operation 91, the first domain transforming unit 31 transforms an input signal IN from the time domain to the time/frequency domain using a first transformation method in a manner of a complex exponential function to generate a first signal expressed as a real part and a second signal expressed as an imaginary part.

In operation 92, the second domain transforming unit 32 transforms each sub-band of the first and second signals to the frequency domain using a second transformation method to generate a third signal and a fourth signal, respectively.

In operation 93, the ISC selecting unit 332 selects ISCs from the third signal using the fourth signal, and the ISC encoding unit 331 encodes the ISCs selected from the third signal.

In operation 94, the PNS encoding unit 333 encodes residual spectral components in which the ISCs are removed from the third signal.

In this case, the audio signal encoding method further comprises an operation in which the multiplexing unit 34 multiplexes a result obtained by performing the ISC encoding, and the encoded residual spectral components, and generates a bitstream.

Figure 10:
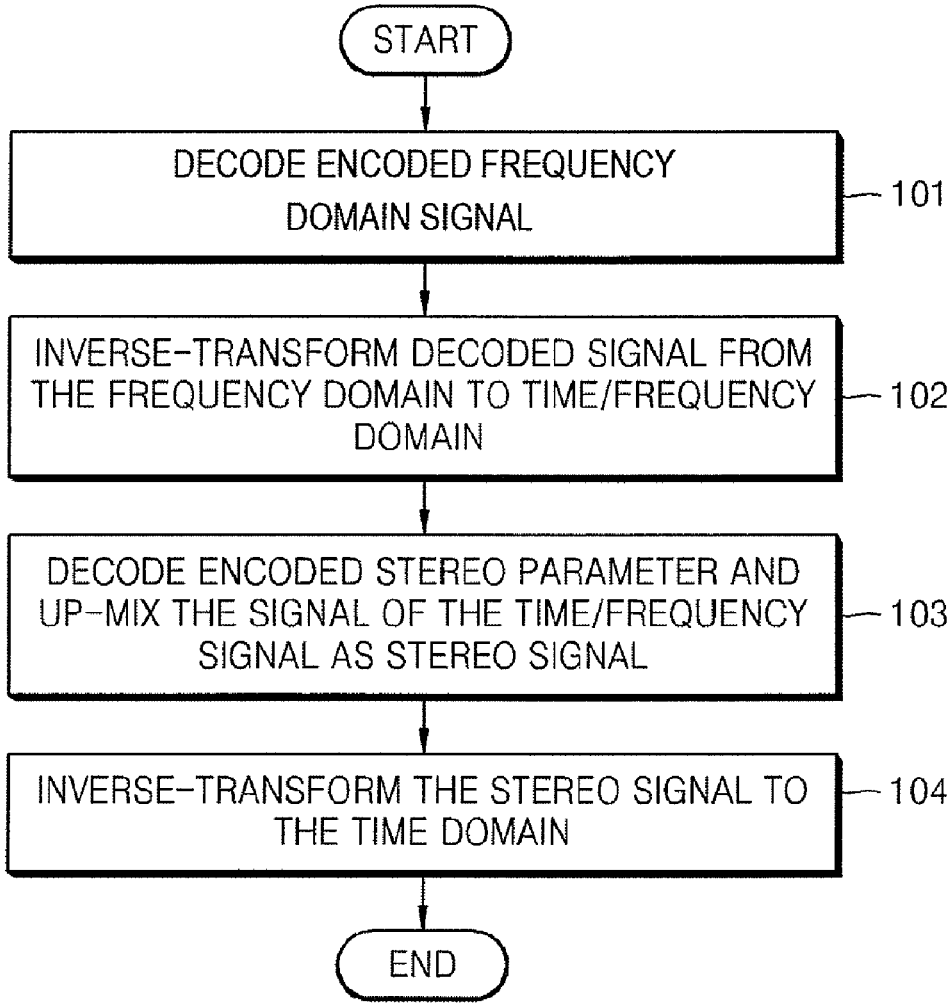
FIG. 10 is a flowchart of an audio signal decoding method according to an embodiment of the present invention.

FIG. 10 is a flowchart of an audio signal decoding method according to an embodiment of the present invention. Referring to FIG. 10, the audio signal decoding method comprises time serial operations performed in the audio signal decoding apparatus shown in FIG. 4. Thus, although it is not described in the present embodiment, the description of the audio signal decoding apparatus shown in FIG. 4 is applied to the audio signal decoding method of the present embodiment.

In operation 101, the frequency domain decoding unit 42 decodes the encoded frequency domain signal. In more detail, the frequency domain decoding unit 42 decodes the result obtained by performing ISC encoding in the frequency domain, the encoded residual spectral components in the frequency domain, and combines the result of the ISC decoding and the decoded residual spectral components.

In operation 102, the first domain inverse transforming unit 43 inverse-transforms the decoded signal from the frequency domain to the time/frequency domain using a first inverse transformation method.

In operation 103, the stereo decoding unit 45 decodes an encoded stereo parameter and up-mixes the signal of the time/frequency signal as a stereo signal.

In operation 104, the second domain inverse transforming unit 46 inverse-transforms the stereo signal to the time domain using a second inverse transformation method.

The audio signal decoding method further comprises an operation in which the high frequency band decoding unit 44 decodes an encoded high frequency band parameter and generates a high frequency band signal based on a low frequency band signal of the time/frequency domain.

Figure 11:
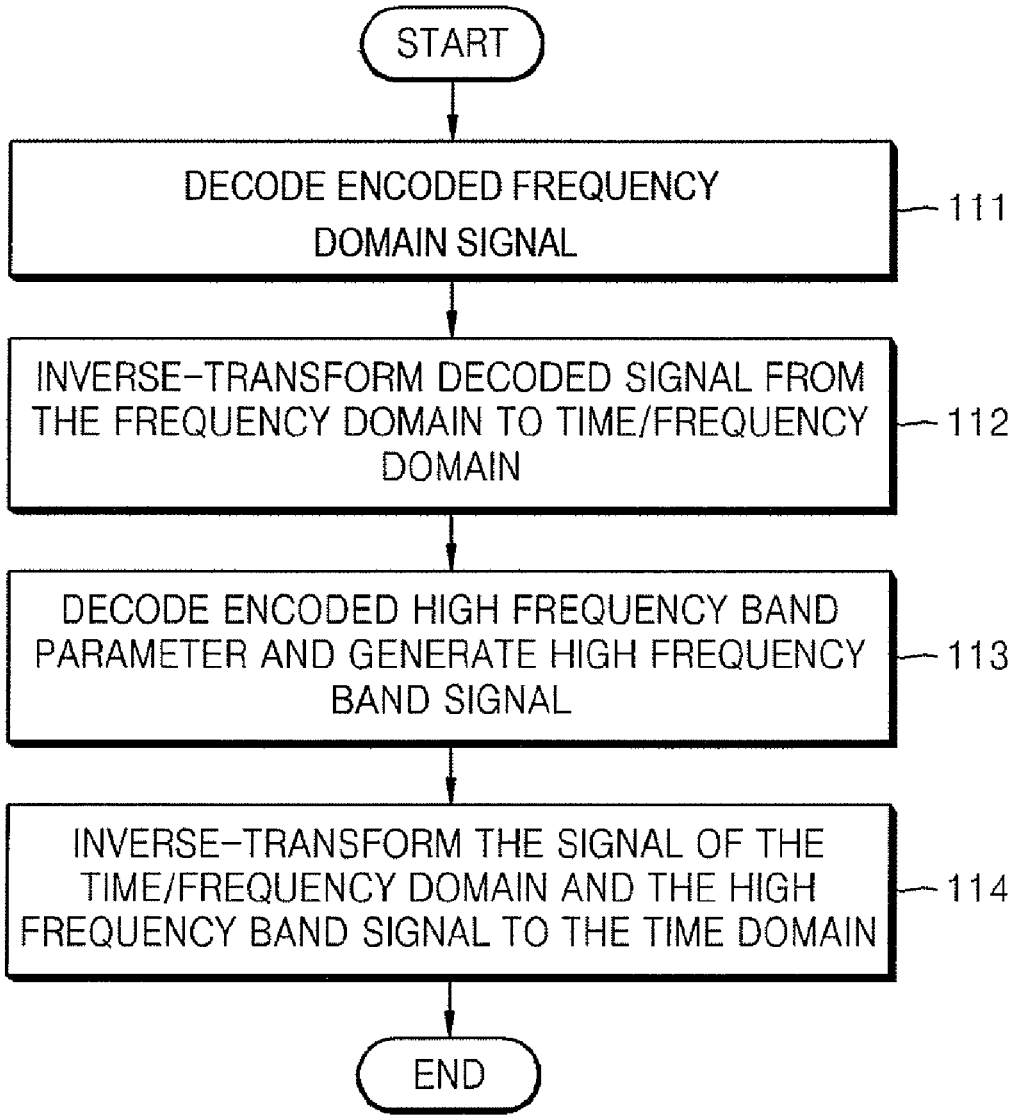
FIG. 11 is a flowchart of an audio signal decoding method according to another embodiment of the present invention.

FIG. 11 is a flowchart of an audio signal decoding method according to another embodiment of the present invention. Referring to FIG. 11, the audio signal decoding method comprises time serial operations performed in the audio signal decoding apparatus shown in FIG. 5. Thus, although it is not described in the present embodiment, the description of the audio signal decoding apparatus shown in FIG. 5 is applied to the audio signal decoding method of the present embodiment.

In operation 111, the frequency domain decoding unit 42 decodes the encoded frequency domain signal. In more detail, the frequency domain decoding unit 42 decodes a result obtained by performing ISC encoding in the frequency domain, the encoded residual spectral components in the frequency domain, and combines the result of the ISC decoding and the decoded residual spectral components.

In operation 112, the first domain inverse transforming unit 43 inverse-transforms the decoded signal from the frequency domain to a time/frequency domain using a first inverse transformation method.

In operation 113, the high frequency band decoding unit 44 decodes an encoded high frequency band parameter and generates a high frequency band signal based on a low frequency band signal of the time/frequency domain.

In operation 114, the second domain inverse transforming unit 46 inverse-transforms the signals of the time/frequency domain and the high frequency band signal to the time domain using a second inverse transformation method.

Figure 12:
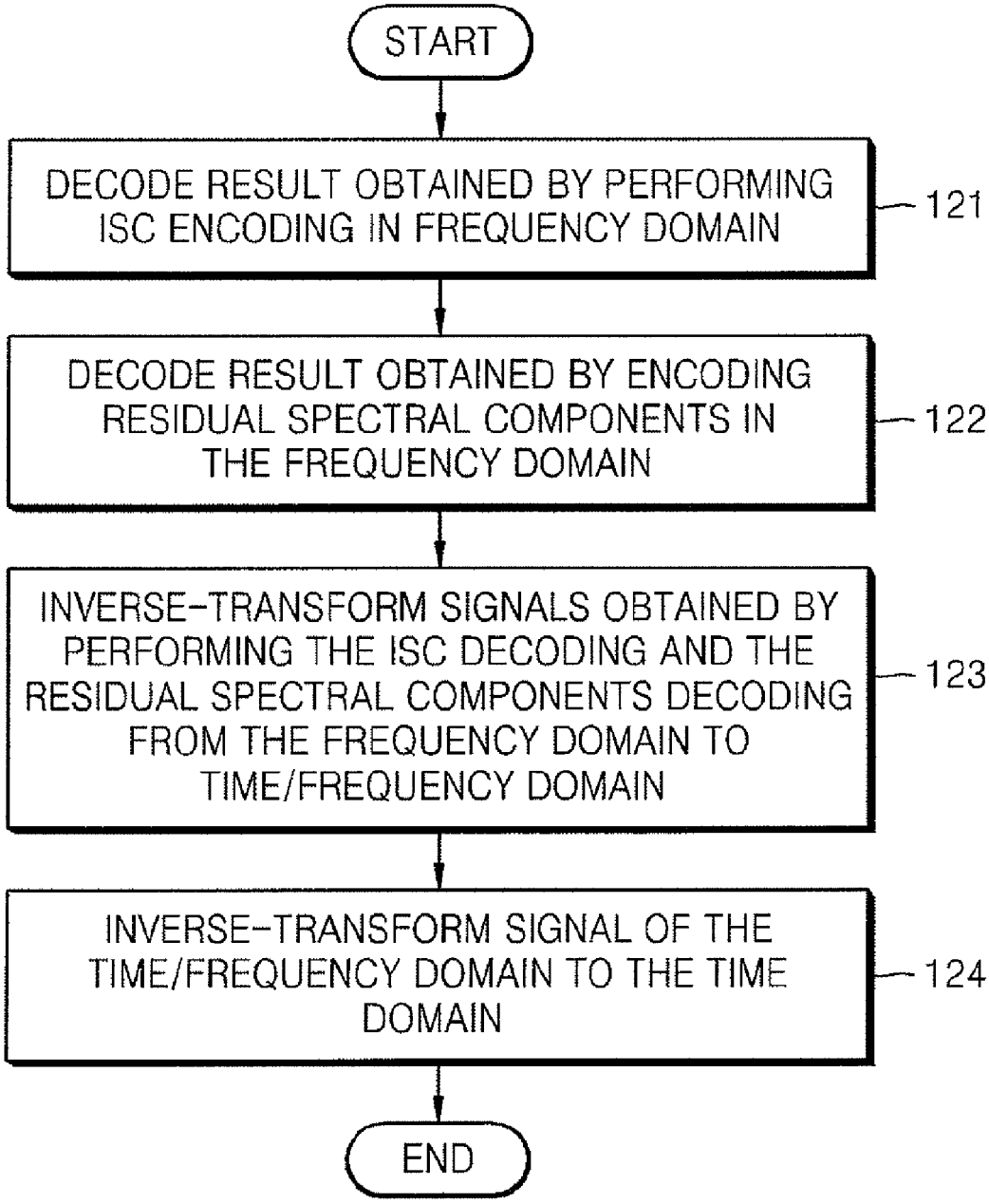
FIG. 12 is a flowchart of an audio signal decoding method according to another embodiment of the present invention.

FIG. 12 is a flowchart of an audio signal decoding method according to another embodiment of the present invention. Referring to FIG. 12, the audio signal decoding method comprises time serial operations performed in the audio signal decoding apparatus shown in FIG. 6. Thus, although it is not described in the present embodiment, the description of the audio signal decoding apparatus shown in FIG. 6 is applied to the audio signal decoding method of the present embodiment.

In operation 121, the ISC decoding unit 621 decodes a result obtained by performing ISC encoding in the frequency domain.

In operation 122, the PNS decoding unit 622 decodes the encoded residual spectral components in the frequency domain.

In operation 123, the first domain inverse transforming unit 63 inverse-transforms the signals obtained by performing the ISC decoding and the decoding the residual spectral components from the frequency domain to a time/frequency domain using a first inverse transformation method.

In operation 124, the second domain inverse transforming unit 64 inverse-transforms the signals of the time/frequency domain to the time domain using a second inverse transformation method.

The present invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, and optical data storage devices. The computer readable recording medium can also be distributed network coupled computer systems so that the computer readable code is stored and executed in a distributed fashion.

The present invention transforms an input signal from the time domain to the time/frequency domain, extracts a stereo parameter from the signals of the time/frequency domain, down-mixes the signals of the time/frequency domain, transforms each sub-band of the down-mixed signals to the frequency domain, encodes the signals of the frequency domain in the frequency domain, thereby reducing the number of calculations in a process of transforming the input signal into different domains, and the encoding delay as a whole, so that encoding efficiency can be increased.

Furthermore, when the input signal is transformed from the time domain to the time/frequency domain, the present invention generates two signals expressed as a real part and an imaginary part, respectively, using a transformation method in a manner of a complex exponential function, so that the two signals expressed as the real part and the imaginary part can be used to measure energy in a process of encoding a stereo parameter and a high frequency band parameter.

While the present invention has been particularly shown and described with reference to exemplary embodiments thereof, it will be understood by those of ordinary skill in the art that various changes in form and details may be made therein without departing from the spirit and scope of the present invention as defined by the following claims. The preferred embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. An audio signal encoding method comprising:

transforming an input signal from a time domain to a time/frequency domain using a first transformation method;

extracting a stereo parameter from a signal of the time/frequency domain, encoding the stereo parameter, and down-mixing the signal of the time/frequency domain;

transforming each of sub-bands of the down-mixed signal to a frequency domain by using a second transformation method; and encoding the signal of the frequency domain in the frequency domain.

2. The method of claim 1, further comprising: extracting a high frequency band parameter from a high frequency band signal that corresponds to a frequency band greater than a predetermined threshold value of the down-mixed signals and encoding the high frequency band parameter.

3. The method of claim 2, further comprising: multiplexing the encoded stereo parameter, a result obtained by encoding the signal of the frequency domain in the frequency domain, and the encoded high frequency band parameter, and generating a bitstream.

4. The method of claim 1, wherein in the transforming of the input signal, the first transformation method in a manner of a complex exponential function is used to generate, from the input signal, a first signal expressed as a real part of the time/frequency domain and a second signal expressed as an imaginary part of the time/frequency domain.

5. The method of claim 4, wherein in the extracting of the stereo parameter, the stereo parameter is extracted from each of the first and second signals and each of the first and second signals is down-mixed.

6. The method of claim 5, wherein in the transforming of each sub-band of the down-mixed signal, the second transformation method is used to generate a third signal of the frequency domain from each sub-band of the down-mixed first signal, and a fourth signal of the frequency domain from each sub-band of the down-mixed second signal.

7. The method of claim 6, wherein the encoding of the signal of the frequency domain comprises:

selecting important spectral components (ISCs) from the third signal using the fourth signal and encoding the ISCs; and encoding residual spectral components in which the ISCs are removed from the third signal.

8. The method of claim 7, further comprising: multiplexing the encoded stereo parameter, a result obtained by performing the ISC encoding, and a result obtained by encoding the residual spectral components, and generating a bitstream.

9. A method of decoding an audio bitstream including a result of encoding in a frequency domain of an encoding port and an encoded stereo parameter, the method comprising:

decoding the result of encoding in a frequency domain in the frequency domain;

inverse-transforming the decoded signal from the frequency domain to a time/frequency domain using a first inverse transformation method;

decoding an encoded stereo parameter and up-mixing the signal of the time/frequency signal as a stereo signal; and inverse-transforming the stereo signal to the time domain using a second inverse transformation method.

10. The method of claim 9, wherein the audio bitstream further comprises an encoded high frequency band parameter, wherein the method further comprises: decoding the encoded high frequency band parameter and generating a high frequency band signal based on a low frequency band signal of the time/frequency domain.

11. The method of claim 9, wherein the decoding of the result comprises:

decoding a result obtained by performing ISC encoding in the frequency domain;

decoding a result obtained by encoding residual spectral components in the frequency domain; and combining the results of the ISC decoding and the decoding of the residual spectral components.

12. A method of decoding an audio bitstream including a result of encoding in a frequency domain of an encoding port and an encoded stereo parameter, the method comprising:

decoding the result of encoding in the frequency domain in the frequency domain;

inverse-transforming the decoded signal from the frequency domain to a time/frequency domain using a inverse transformation method; and inverse-transforming the decoded signal from the time/frequency domain to a time domain.

13. The method of claim 12, wherein the decoding of the result comprises:

decoding a result obtained by performing ISC encoding in the frequency domain;

decoding a result obtained by encoding residual spectral components in the frequency domain; and combining the results of the ISC decoding and the decoding of the residual spectral components.

14. A method of decoding an audio bitstream including a result of encoding in a frequency domain of an encoding port and an encoded high frequency band parameter, the method comprising:

decoding the result of encoding in a frequency domain in the frequency domain;

inverse-transforming the decoded signal from the frequency domain to a time/frequency domain using a first inverse transformation method;

decoding an encoded high frequency band parameter and generating a high frequency band signal based on a low frequency band signal of the time/frequency domain; and inverse-transforming the signals of the time/frequency domain and the high frequency band signal to the time domain using a second inverse transformation method.

15. The method of claim 14, wherein the decoding of the result comprises:

decoding a result obtained by performing ISC encoding in the frequency domain;

decoding a result obtained by encoding residual spectral components in the frequency domain; and combining the results of the ISC decoding and the decoding of the residual spectral components.

16. An apparatus for decoding an audio bitstream including a result of encoding in a frequency domain of an encoding port and an encoded stereo parameter, the apparatus comprising:

a frequency domain decoding unit to decode the result of encoding in a frequency domain in the frequency domain;

a first domain inverse transforming unit to inverse-transform the decoded signal from the frequency domain to a time/frequency domain using a first inverse transformation method;

a stereo decoding unit to decode an encoded stereo parameter and up-mixing the signal of the time/frequency signal as a stereo signal; and a second domain inverse transforming unit to inverse-transform the stereo signal to the time domain using a second inverse transformation method.

17. The apparatus of claim 16, wherein the audio bitstream further comprises an encoded high frequency band parameter, wherein the apparatus further comprises: a high frequency band decoding unit to decode the encoded high frequency band parameter and to generate a high frequency band signal based on a low frequency band signal of the time/frequency domain.

18. The apparatus of claim 16, wherein the first domain inverse transforming unit comprises:

an ISC decoding unit to decode a result obtained by performing ISC encoding in the frequency domain;

a PNS decoding unit to decode residual spectral components encoded in the frequency domain; and a spectrum combining unit to combine the decoded ISCs and the decoded residual spectral components.

19. An audio signal encoding method, comprising:

transforming an input signal from a time domain to a time/frequency domain using a first transformation method;

encoding the signal of the time/frequency domain, and down-mixing the signal of the time/frequency domain;

transforming each of sub-bands of the down-mixed signal to a frequency domain by using a second transformation method; and encoding the signal of the frequency domain in the frequency domain.

20. An audio signal encoding method, comprising:

transforming an input signal from a time domain to a time/frequency domain using a first transformation method;

transforming the sub-bands of the signal of the time/frequency domain to a signal of a frequency domain using a second transformation method;

encoding the signal of the frequency domain in the frequency domain; and multiplexing the encoded signal in the frequency domain to generate a bitstream.

* * * * *